US009807524B2

(12) United States Patent
Shennib et al.

(10) Patent No.: US 9,807,524 B2
(45) Date of Patent: Oct. 31, 2017

(54) TRENCHED SEALING RETAINER FOR CANAL HEARING DEVICE

(71) Applicant: iHear Medical, Inc., San Leandro, CA (US)

(72) Inventors: Adnan Shennib, Oakland, CA (US); Victor Valenzuela, Hayward, CA (US)

(73) Assignee: iHear Medical, Inc., San Leandro, CA (US)

( * ) Notice: Subject to any disclaimer, the term of this patent is extended or adjusted under 35 U.S.C. 154(b) by 154 days.

(21) Appl. No.: 14/832,774

(22) Filed: Aug. 21, 2015

(65) Prior Publication Data

US 2016/0066110 A1 Mar. 3, 2016

Related U.S. Application Data

(60) Provisional application No. 62/044,190, filed on Aug. 30, 2014.

(51) Int. Cl.
*H04R 25/00* (2006.01)

(52) U.S. Cl.
CPC ..... *H04R 25/652* (2013.01); *H04R 2460/11* (2013.01); *H04R 2460/15* (2013.01)

(58) Field of Classification Search
CPC ..... H04R 25/652; H04R 2460/11; H04R 2460/15
USPC ..... 381/322, 324, 325, 328
See application file for complete search history.

(56) References Cited

U.S. PATENT DOCUMENTS

| | | | |
|---|---|---|---|
| 4,759,070 | A | 7/1988 | Voroba |
| 5,197,332 | A | 3/1993 | Shennib |
| 5,327,500 | A | 7/1994 | Campbell |
| 5,553,152 | A | 9/1996 | Newton |

(Continued)

FOREIGN PATENT DOCUMENTS

| | | | |
|---|---|---|---|
| KR | 1020100042370 | A | 4/2010 |
| WO | 99/07182 | A2 | 2/1999 |

(Continued)

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

(Continued)

*Primary Examiner* — Davetta W Goins
*Assistant Examiner* — Phylesha Dabney
(74) *Attorney, Agent, or Firm* — Dorsey & Whitney LLP

(57) ABSTRACT

Examples of retaining seal assemblies for acoustically sealing and retaining a canal hearing device or an earpiece within the ear canal are disclosed. The retaining seal assembly may include one or more flanges and a clip element. The flanges may include elongate trenches along an exterior surface of one or more of the flanges. The elongate trenches may allow the flange to conform to the shape of the ear canal and distribute concentric compressive forces when the seal assembly is inserted in the ear canal. The clip element may be formed of a relatively rigid material and may include one or more locking tabs. The conforming flanges may be concentrically positioned over the clip element. The seal assembly may include a debris barrier to provide protection for a sound outlet of the canal hearing device or the earpiece.

35 Claims, 11 Drawing Sheets

(56) References Cited

U.S. PATENT DOCUMENTS

| | | | | |
|---|---|---|---|---|
| 5,645,074 | A | 7/1997 | Shennib et al. | |
| 5,659,621 | A | 8/1997 | Newton | |
| 5,701,348 | A | 12/1997 | Shennib et al. | |
| 5,785,661 | A | 7/1998 | Shennib et al. | |
| 6,137,889 | A | 10/2000 | Shennib et al. | |
| 6,212,283 | B1 | 4/2001 | Fletcher et al. | |
| 6,319,207 | B1 | 11/2001 | Naidoo | |
| 6,359,993 | B2 | 3/2002 | Brimhall | |
| 6,367,578 | B1 | 4/2002 | Shoemaker | |
| 6,379,314 | B1 | 4/2002 | Horn | |
| 6,382,346 | B2 | 5/2002 | Brimhall et al. | |
| 6,428,485 | B1 | 8/2002 | Rho | |
| 6,447,461 | B1 | 9/2002 | Eldon | |
| 6,473,513 | B1 | 10/2002 | Shennib et al. | |
| 6,522,988 | B1 | 2/2003 | Hou | |
| 6,546,108 | B1 | 4/2003 | Shennib et al. | |
| 6,674,862 | B1 | 1/2004 | Magilen | |
| 6,724,902 | B1 | 4/2004 | Shennib et al. | |
| 6,840,908 | B2 | 1/2005 | Edwards et al. | |
| 6,937,735 | B2 | 8/2005 | DeRoo et al. | |
| 6,940,988 | B1 | 9/2005 | Shennib et al. | |
| 6,978,155 | B2 | 12/2005 | Berg | |
| 7,010,137 | B1 | 3/2006 | Leedom et al. | |
| 7,016,511 | B1 | 3/2006 | Shennib | |
| 7,037,274 | B2 | 5/2006 | Thoraton et al. | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 7,854,704 | B2 | 12/2010 | Givens et al. | |
| 7,945,065 | B2 | 5/2011 | Menzl et al. | |
| 8,073,170 | B2 | 12/2011 | Kondo et al. | |
| 8,077,890 | B2 | 12/2011 | Schumaier | |
| 8,155,361 | B2 | 4/2012 | Schindler | |
| 8,184,842 | B2 | 5/2012 | Howard et al. | |
| 8,243,972 | B2 | 8/2012 | Latzel | |
| 8,284,968 | B2 | 10/2012 | Schumaier | |
| 8,287,462 | B2 | 10/2012 | Givens et al. | |
| 8,340,335 | B1 | 12/2012 | Shennib | |
| 8,379,871 | B2 | 2/2013 | Michael et al. | |
| 8,396,237 | B2 | 3/2013 | Schumaier | |
| 8,447,042 | B2 | 5/2013 | Gurin | |
| 8,467,556 | B2 | 6/2013 | Shennib et al. | |
| 8,571,247 | B1 | 10/2013 | Oezer | |
| 8,718,306 | B2 | 5/2014 | Gommel et al. | |
| 8,798,301 | B2 | 8/2014 | Shennib | |
| 8,855,345 | B2 | 10/2014 | Shennib et al. | |
| 9,060,233 | B2 | 6/2015 | Shennib et al. | |
| 9,088,852 | B2 | 7/2015 | Shennib et al. | |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2003/0007647 | A1 | 1/2003 | Nielsen et al. | |
| 2005/0141743 | A1* | 6/2005 | Seto | H04R 1/1016 381/371 |
| 2005/0190938 | A1 | 9/2005 | Shennib et al. | |
| 2005/0245991 | A1 | 11/2005 | Faltys et al. | |
| 2005/0249370 | A1 | 11/2005 | Shennib et al. | |
| 2005/0259840 | A1 | 11/2005 | Gable et al. | |
| 2005/0283263 | A1 | 12/2005 | Eaton et al. | |
| 2006/0210104 | A1 | 9/2006 | Shennib et al. | |
| 2006/0291683 | A1 | 12/2006 | Urso et al. | |
| 2007/0076909 | A1 | 4/2007 | Roeck et al. | |
| 2008/0240452 | A1 | 10/2008 | Burrows et al. | |
| 2008/0273726 | A1 | 11/2008 | Yoo et al. | |
| 2010/0040250 | A1 | 2/2010 | Gerbert | |
| 2010/0119094 | A1 | 5/2010 | Sjursen et al. | |
| 2010/0145411 | A1 | 6/2010 | Spitzer | |
| 2010/0239112 | A1 | 9/2010 | Howard et al. | |
| 2010/0284556 | A1 | 11/2010 | Young | |
| 2011/0058697 | A1 | 3/2011 | Shennib et al. | |
| 2011/0188689 | A1 | 8/2011 | Beck et al. | |
| 2011/0200216 | A1 | 8/2011 | Lee et al. | |
| 2011/0206225 | A1 | 8/2011 | Møller et al. | |
| 2011/0280425 | A1* | 11/2011 | Gibbons | H04R 1/1016 381/328 |
| 2012/0051569 | A1 | 3/2012 | Blamey et al. | |
| 2012/0130271 | A1 | 5/2012 | Margolis et al. | |
| 2012/0183164 | A1 | 7/2012 | Foo et al. | |
| 2012/0183165 | A1 | 7/2012 | Foo et al. | |
| 2012/0189140 | A1 | 7/2012 | Hughes | |
| 2012/0213393 | A1 | 8/2012 | Foo et al. | |
| 2012/0215532 | A1 | 8/2012 | Foo et al. | |
| 2012/0302859 | A1 | 11/2012 | Keefe | |
| 2013/0010406 | A1 | 1/2013 | Stanley | |
| 2013/0243229 | A1 | 9/2013 | Shennib et al. | |
| 2013/0294631 | A1 | 11/2013 | Shennib et al. | |
| 2014/0003639 | A1 | 1/2014 | Shennib et al. | |
| 2014/0150234 | A1 | 6/2014 | Shennib et al. | |
| 2014/0153761 | A1 | 6/2014 | Shennib et al. | |
| 2014/0153762 | A1 | 6/2014 | Shennib et al. | |
| 2014/0254843 | A1 | 9/2014 | Shennib | |
| 2014/0254844 | A1 | 9/2014 | Shennib | |
| 2014/0294214 | A1* | 10/2014 | Zhao | H04R 25/608 381/330 |
| 2015/0023512 | A1 | 1/2015 | Shennib | |
| 2015/0023534 | A1 | 1/2015 | Shennib | |

FOREIGN PATENT DOCUMENTS

| | | | |
|---|---|---|---|
| WO | 2010/091480 | A1 | 8/2010 |
| WO | 2011128462 | A2 | 10/2011 |
| WO | 2015009564 | A1 | 1/2015 |
| WO | 2015009569 | A1 | 1/2015 |

OTHER PUBLICATIONS

"Methods for Calculation of the Speech Intelligibility Index", American National Standards Institute, Jun. 6, 1997.

"Specification for Audiometers", American National Standards Institute, Nov. 2, 2010.

"User Manual—2011", AMP Personal Audio Amplifiers.

Abrams "A Patient-adjusted Fine-tuning Approach for Optimizing the Hearing Aid Response", The Hearing Review, Mar. 24, 2011, 1-8.

ASHA, "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, "Hearing Measurements", National Institute for Occupational Safety and Health, Jun. 2006, 183-232.

Kiessling "Hearing aid fitting procedures—state-of-the-art and current issues", Scandinavian Audiology vol. 30, Suppl 52, 2001, 57-59.

Nhanes, "Audiometry Procedures Manual", National Health and Nutrition Examination Survey, Jan. 2003, 1-105.

Traynor, "Prescriptive Procedures", www.rehab.research.va.gov/mono/ear/traynor.htm, Jan. 1999, 1 16.

World Health Organization, "Deafness and Hearing Loss", www.who.int/mediacentre/factsheets/fs300/en/index.html, Feb. 2013, 1-5.

* cited by examiner

TRENCHED SEALING RETAINER FOR CANAL HEARING DEVICE

CROSS-REFERENCE TO RELATED APPLICATIONS

This application claims the benefit under 35 U.S.C. 119 of the earlier filing date of U.S. Provisional Application 62/044,190 entitled "TRENCHED SEALING RETAINER FOR CANAL HEARING DEVICE," filed Aug. 30, 2014. The aforementioned provisional application is hereby incorporated by reference in its entirety, for any purpose.

TECHNICAL FIELD

Examples described herein relate to hearing devices, and more particularly methods and systems for acoustically sealing and retaining a canal hearing device, or an earpiece of a hearing device, within the ear canal. This application is related to U.S. Pat. No. 8,467,556, titled, "CANAL HEARING DEVICE WITH DISPOSABLE BATTERY MODULE," U.S. Pat. No. 8,867,768, titled "EARPIECE ASSEMBLY WITH FOIL CLIP," filed on Nov. 30, 2012, U.S. Pat. No. 8,855,345, titled, "BATTERY MODULE FOR PERPENDICULAR DOCKING INTO A CANAL HEARING DEVICE," filed on Mar. 19, 2013, and U.S. Pat. No. 9,060,233, titled, "RECHARGEABLE CANAL HEARING DEVICE AND SYSTEMS," filed on Mar. 6, 2013; all of which are incorporated herein by reference in their entirety for any purpose.

BACKGROUND

The ear canal 10 (FIG. 2) is generally narrow and tortuous and is approximately 26 millimeters (mm) long from the canal aperture 11 to the tympanic membrane 15 (eardrum). The lateral part is flexible and referred to as the cartilaginous canal 12 due to the underlying cartilaginous tissue 16 beneath the skin. The medial part, proximal to the tympanic membrane, is rigid and referred to as the bony region 13 due to the underlying bone tissue. A characteristic first bend occurs roughly at the aperture 11 of the ear canal 10. A second characteristic bend 8 occurs roughly at the bony-cartilaginous junction and separates the cartilaginous region 12 and the bony region 13. The dimensions and contours of the ear canal 10 may vary significantly among individuals, but are generally narrow with little space for accommodating miniaturized components therewithin. The ear canal 10 is generally sensitive to touch and pressure, particularly in the deeper region, which can readily experience discomfort, abrasion and trauma with pressure and rigid contact. Abrasion of the skin inside the ear canal 10 due to hearing aid use is common and generally limits insertions to the lateral (outer) portions of the ear canal 19. The lateral portion (away from the eardrum 15) of the ear canal 10 is relatively physiologically more active than the medial portion (toward the eardrum 15), for example produces more sweat and cerumen (earwax).

Placement of a hearing device inside the ear canal 10 is generally desirable for various advantages such as reduction of the acoustic occlusion effect, improved energy efficiency, reduced distortion, reduced receiver vibrations, and improved high frequency response. Placement inside the ear canal 10 may also be desirable for cosmetic reasons, with many of the hearing impaired preferring to wear inconspicuous hearing devices. A canal hearing device can be inserted entirely or partially inside the ear canal 10. In the context of this application, a "canal hearing device" refers to any hearing device with sound delivery inside the ear canal, whether partially or fully inserted therein.

Sealing inside the ear canal 10 reduces the acoustical feedback which may occur when there is acoustic leakage from an output of a receiver of the hearing device to an input of a microphone of the hearing device through an uncontrolled leakage path. Additionally, an acoustic occlusion (amplified self-voice) effect may result from occlusion of the ear canal 10 by the hearing device. Venting of hearing devices is usually required to address aeration within the ear canal 10 and to relieve the acoustic occlusion effect. Conventional hearing devices provide venting by including tubes or channels that connect the ambient air in the atmosphere outside the ear with the residual volume in the ear canal 10 occluded by the hearing device.

SUMMARY

A retaining seal assembly for a canal hearing device may include one or more compliant flanges and a clip element. The retaining seal assembly may include a medial flange. The medial flange may be formed of a compliant material. The medial flange may include relatively small medial trenches along an exterior surface of the medial flange. The medial flange may conform to the shape of an ear canal and distribute concentric compressive forces when the retaining seal assembly is inserted in the ear canal.

The removable seal assembly may include a lateral flange. The lateral flange may be formed of the compliant material. The lateral flange may include relatively large lateral trenches along an exterior surface of the lateral flange. The lateral flange may conform to the shape of the ear canal and distribute concentric compressive forces when the retaining seal assembly is inserted in the ear canal.

The clip element may be formed of a relatively rigid material. The clip element may be coupled to at least one of the medial and lateral flanges and/or a sleeve portion of the retaining seal assembly. The sleeve portion may couple the lateral flange to the medial flange. The clip element may be bonded to at least one of the medial and lateral flanges and/or the sleeve portion using an adhesive. At least one of the medial and lateral flanges may be concentrically positioned over the clip element.

The lateral trenches and medial trenches may be sized and configured to provide acoustic sealing in an audiometric frequency range and low frequency venting when the retaining seal assembly is placed in the ear canal. Open trenches of any of the lateral and medial trenches may facilitate air venting and a conforming fit when the retaining seal assembly is placed in the ear canal. Blocked trenches of any of the lateral and medial trenches may facilitate a conforming fit when the retaining seal assembly is placed in the ear canal.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof, including the best mode presently contemplated of practicing the invention, when taken in conjunction with the accompanying drawings, in which.

DETAILED DESCRIPTION

Certain details are set forth below to provide a sufficient understanding of embodiments of the invention. Some embodiments, however, may not include all details described. In some instances, well known structures may not be shown in order to avoid unnecessarily obscuring the described embodiments of the invention.

The present disclosure describes examples of retaining seal assemblies for acoustically sealing and retaining a canal hearing device or an earpiece within the ear canal. A retaining seal assembly for a canal hearing device according to some examples disclosed herein may include one or more compliant flanges. Any of the flanges may include one or more trenches along an exterior surface of the flange. The trenches may facilitate a conforming fit of the retaining seal assembly in the ear canal. The retaining seal assembly may include a clip element for coupling to the canal hearing device.

Figure 1:
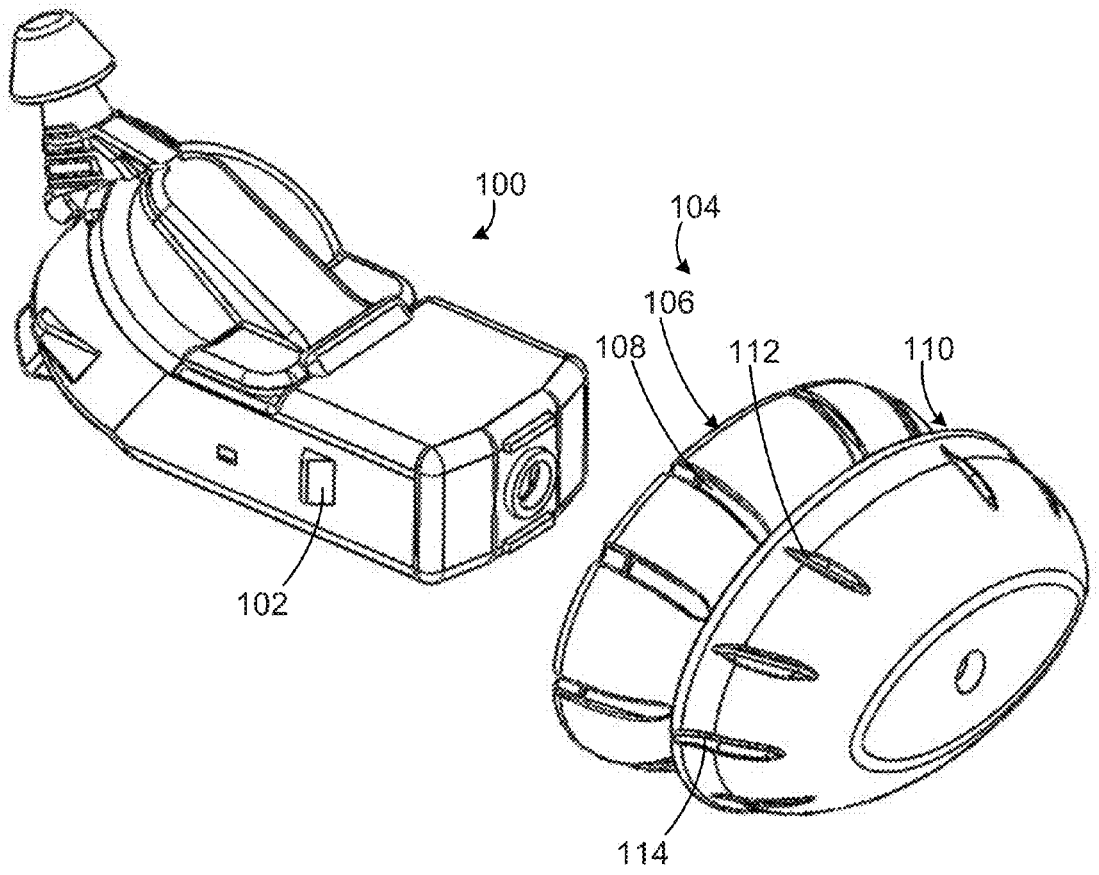
FIG. 1 is an isometric view of a canal hearing device disengaged from a retaining seal assembly, according to some examples.

FIG. 1 is an isometric view of a canal hearing device 100 disengaged from a retaining seal assembly 104, according to some examples. The canal hearing device 100 may be shaped to fit substantially in the ear canal 10. In some examples, the canal hearing device 100 may be a modular hearing device. In some examples, the canal hearing device 100 may include a main module housing durable components and a battery module housing a battery cell within. In some examples, the canal hearing device 100 may be a completely in the canal (CIC) type device sized and shaped to fit substantially within the ear canal 10. In some examples, the earpiece may be a component of a behind the ear (BTE) hearing device, where circuitry of the BTE hearing device is external to the ear and the earpiece is provided in the ear canal 10 and includes a speaker communicatively coupled to the circuitry of the BTE hearing device. Although reference is made to the canal hearing device 100, it will be understood that concepts described in relation to the canal hearing device 100 may be applicable to the earpiece of a BTE hearing device.

The retaining seal assembly 104 may include a relatively compliant sealing element and a relatively rigid clip element 150. The compliant sealing element of the retaining seal assembly 104 may include one or more flanges 106 and 110 to conform to the shape of the ear canal 10 in an acoustically sealing manner. The compliant sealing element may be formed of a compliant, biocompatible material, for example Silicone or neoprene. The flanges may be implemented as medial (inner) flange 110 and lateral (outer) flange 106. The medial flange 110 may be formed of a first compliant material and the lateral flange 106 may be formed of a second compliant material. The first and second compliant materials may be, but need not be, the same material, e.g., biocompatible materials such as Silicone or neoprene. The flanges 106 and 110 may interchangeably be referred to herein as compliant lateral flange 106 and compliant medial flange 110, respectively. The flanges 106 and 110 may include trenches (grooves) 108, 112, and 114 along an exterior surface of flanges 106 and 110. One or more of the trenches herein may be elongate trenches. An elongate trench may have a length greater than the width of the trench. The trenches 108, 112, and 114 may allow the flanges to conform to the shape of the ear canal 10 and distribute concentric compressive forces when the retaining seal assembly 104 is inserted in the ear canal 10. Any one or combination of the trenches 108, 112, 114 may provide venting.

Figure 2:
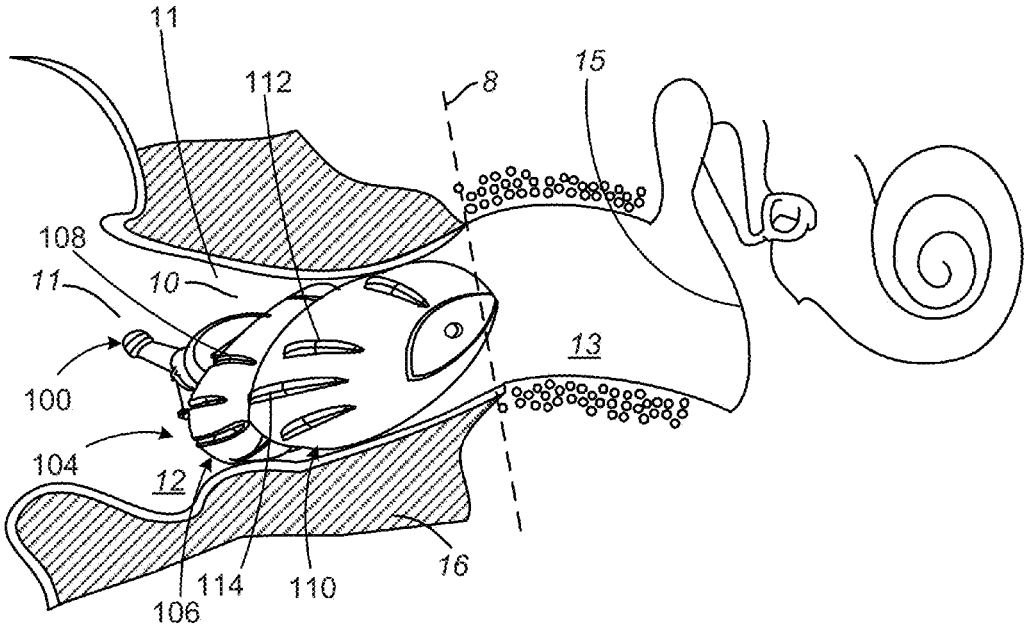
FIG. 2 is a view of a canal hearing device with a retaining seal assembly attached thereto and inserted in the ear canal, according to some examples.

FIG. 2 is a view of a canal hearing device 100 with a retaining seal assembly 104 coupled thereto inserted in the ear canal 10, according to some examples. In some examples, the retaining seal assembly 104 may concentrically encapsulate the medial end of the canal hearing device 100. The retaining seal assembly 104 may be sized and shaped to be placed within the ear canal 10. In some examples, the retaining seal assembly 104 may be sized and shaped to be provided within a cartilaginous region 12 of the ear canal 10. In some examples, the retaining seal assembly 104 may extend into the bony region 13 of the ear canal 10 as well. In some examples, the retaining seal assembly 104 may be removable from the canal hearing device 100, or a portion thereof.

The retaining seal assembly 104 may be configured to enable placement of a canal hearing device 100 up to the bony-cartilaginous junction 8 and/or extending beyond into the bony region 13 while reducing discomfort to a wearer of the canal hearing device 100. For example, retaining seal assembly 104 may be configured such that medial flange 110 of retaining seal assembly 104 may be positioned approximately at the bony-cartilaginous junction 8 and may extend into the bony region for acoustically sealing and delivering amplified sound from the medial end of the canal hearing device 100 towards the eardrum 15 in proximity. In this manner, the canal hearing device 100 can extend safely into the bony region 13, or remain approximately at the junction area 8. The lateral flange 106 may be substantially in the cartilaginous region 12. As will be appreciated by those skilled in the art, sealing at the junction area 8, or medially beyond reduces feedback and minimizes the occlusion effect, which may be objectionable for some hearing impaired individuals, particularly those with significant residual hearing in the low frequency range. By placing the retaining seal assembly 104 concentrically over the canal hearing device 100, which is a rigid and non-compliant member, the risk of damage to the ear may be reduced.

Figure 3:
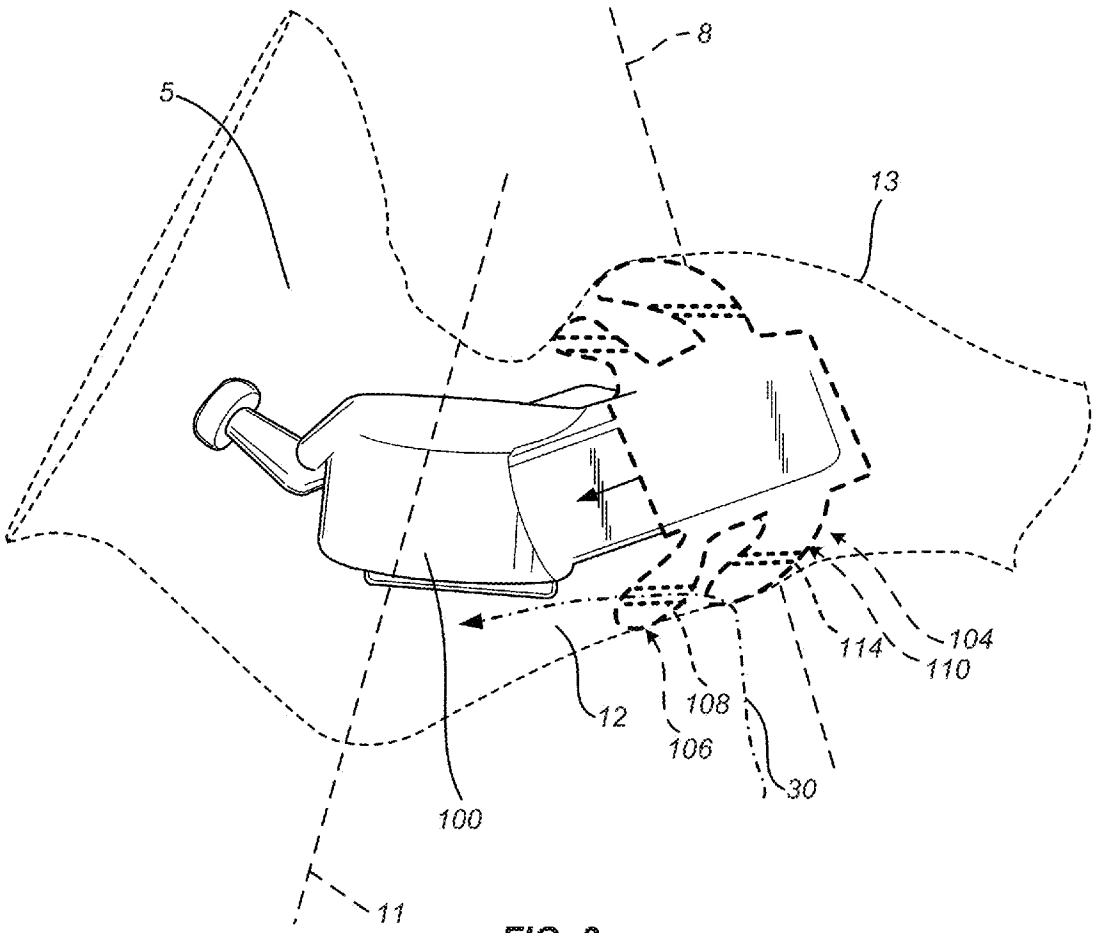
FIG. 3 is a model view of a canal hearing device with a retaining seal assembly attached thereto inserted in the ear canal, where exterior trenches of any of the medial and lateral flanges of the retaining seal assembly allow controlled venting for feedback control and self-voice to pass through, according to some examples.

FIG. 3 is a view of a canal hearing device 100 with a retaining seal assembly 104 attached thereto inserted in the ear canal 10 according to further examples of the present disclosure. Retaining seal assembly 104 may be configured to reduce negative effects of self-voice. Self-voice is a phenomenon in which a user of a canal hearing device 100 may hear their own voice in an abnormal manner due to the blockage of the ear by the canal hearing device 100. Self-voice 30 may include sounds emanating from the vocal tract, user's mouth, or sounds caused by chewing.

The trenches 108, 112, and 114 of the canal hearing device 100 may allow self-voice 30 to pass through the retaining seal assembly 104. When self-voice 30 is provided in the ear canal 10, it may pass through the trenches 108 to the outside the ear canal 10. Trenches 108, 112, and 114 of the canal hearing device 100 may be configured to provide a pathway for self-voice 30 to pass through the canal hearing device 100, thus reducing the occlusion effect which may be caused, at least in part, by self-voice 30. The pathway for self-voice 30 may include a control acoustic conduit provided by a gap between an open trench and the ear canal 10 along the length of the retaining seal assembly 104, as will be described further below.

Figure 4:
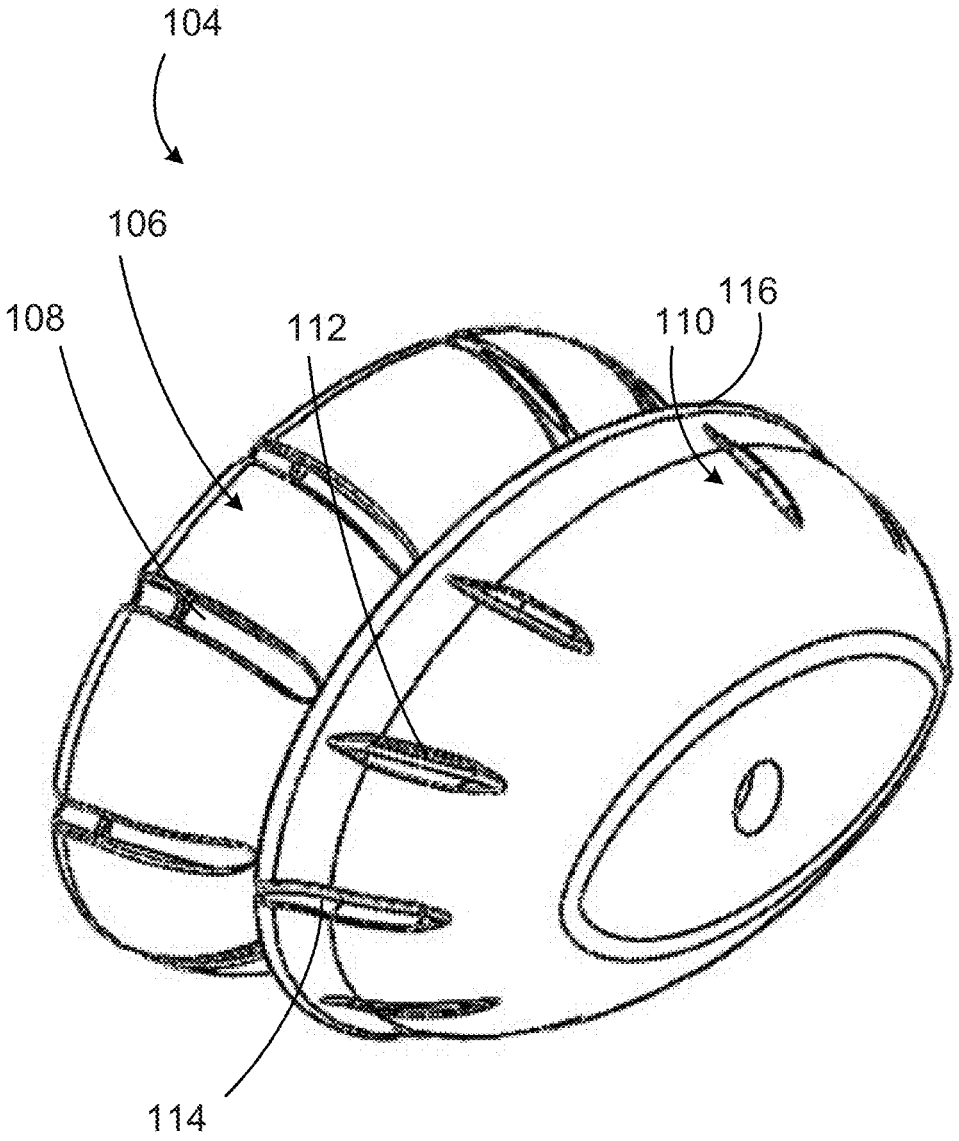
FIG. 4 is an isometric view of a medial end of a retaining seal assembly including relatively small medial trenches of a medial flange and relatively large lateral trenches of a lateral flange, according to some examples.

FIG. 4 is an isometric view of a dual flange embodiment of a retaining seal assembly 104 including medial trenches 112 and 114 on the exterior surface of a medial flange 110 and lateral trenches 108 on the exterior surface of a lateral flange 106. In some examples, the lateral trenches 108 of the lateral flange 106 are larger than the medial trenches 112 and 114 of the medial flange 110 to provide a path of least resistance for self voice 30. In some examples, a combination of trenches 108, 112, and 114 of the lateral flange 106 and the medial flange 110 may provide a combination of acoustic sealing in the audiometric frequency range and venting when the retaining seal assembly 104 is placed in the ear canal 10. The medial flange 110 and the lateral flange 106 may be sized, shaped, and formed from a sufficiently compliant material to conform to the ear canal 10 for acoustic sealing. The trenches 108, 112, and 114 may facilitate acoustic sealing by allowing for uniform concentric compressive forces when the retaining seal assembly 104 is placed within the ear canal 10 so as to prevent buckling and control acoustic leakage. Uniform concentric compressive forces may be achieved by size, shape and arrangement of the trenches 108, 112, and 114 along the exterior surface of the retaining seal assembly 104. A combination of medial and lateral trenches may be shaped and sized to provide a cumulative cross-sectional area sufficient to reduce acoustic leakage at a selected frequency range.

In some examples, the trenches 108, 112, and 114 are configured for selective acoustic attenuation such as low-pass filtering. For example, the trenches 108, 112, and 114 may be configured to provide acoustic attenuation of at least 12 dB at 1000 Hz and above, for example in the range of 1000-4000 Hz, and acoustic leakage (attenuation of less than 10 dB) below 250 Hz. Acoustic attenuation may be achieved by the relative size and shape of the trenches 108, 112, and 114. This selective venting aids in relieving body conducted sounds, which may be predominately in the low frequency range. The diameter of the lateral trenches 108 of the lateral flange 106 is generally larger than diameter of the medial trenches 112 and 114 of the medial flange 110. Thus, the lateral trenches 108 are more permissive for air flow and allow low frequency sounds to pass through as compared to the medial trenches 112 and 114. The medial flange 110 may be more restrictive so as to minimize feedback due to its smaller medial trenches 112 and 114.

In some examples, at least 6 trenches may be provided along an exterior surface of one or more of the flanges. It will be appreciated that different numbers and combinations of flanges and trenches may be provided by the retaining seal assembly 104 to provide substantially uniform concentric compressive forces and conforming fit in the ear canal 10.

Figure 5:
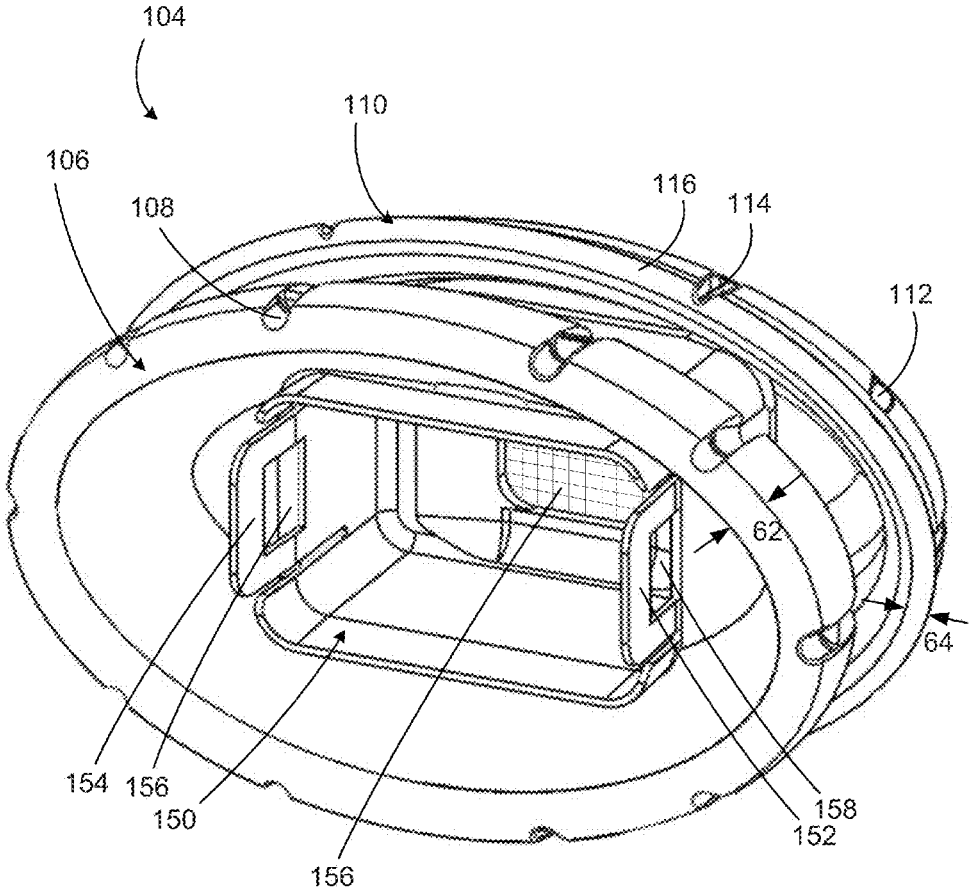
FIG. 5 is a lateral view of a retaining seal assembly including a relatively rigid clip element, according to some examples.

FIG. 5 is a lateral view of the retaining seal assembly 104 including a clip element 150, according to some examples. The clip element 150 may be formed of a relatively thin rigid material compared to the compliant material of the flanges. The clip element 150 may be formed of any of plastic, nylon, or metal materials, or combinations thereof. The clip element 150 may be configured for removably attaching the retaining seal assembly 104 to the canal hearing device 100 or a portion thereof. In some examples, the clip element may have a thickness of about 0.3 mm or less. In some examples, the clip element 150 may include one or more locking tabs (e.g., locking tabs 152 and 154), which may be deformable. In some examples, the one or more locking tabs may include a cut-out (e.g., cut-outs 156 and 158 of locking tabs 154 and 152, respectively). The locking tabs 152 and 154 may facilitate coupling of the clip element 150 to the canal hearing device 100. In some examples, the locking tabs 152 and 154 may couple to locking features 102 (FIG. 1) of the canal hearing device 100. In some examples, the locking features 102 may be bosses. At least one of the flanges 106 and 110 may be concentrically positioned over the clip element 150. The clip element 150 may provide a highly space-efficient, secure attachment to the canal hearing device 100. In further examples, the medial and lateral flanges of retaining seal assembly 104 are non-removably attached to the clip element 150. For example, the clip element 150 may be coupled to a compliant element (e.g., medial flange, or lateral flange) of the retaining seal assembly 104 using an adhesive. In yet further examples, the clip element 150 may be coupled to the retaining seal assembly 104 by stretching or molding a compliant element (e.g., medial flange, or lateral flange) of the retaining seal assembly 104 over the clip element 150.

In some examples, the retaining seal assembly 104 may include a debris barrier 156 to provide protection for the sound port of the canal hearing device 100 when the retaining seal assembly 104 is attached thereto. The debris barrier 156 may be made of a porous film or membrane that is acoustically transparent to permit sound to be transmitted across to the eardrum. The pore size of the membrane may be in the range of about 20 to about 50 microns to allow for acoustic transparency while preventing water and debris from penetrating into the speaker of the canal hearing device 100. The debris barrier 156 may provide an acoustic attenuation of less than 3 dB across an audiometric frequency range of 250-4,000 Hz. In some examples, the debris barrier may provide selective acoustic filtering for a certain frequency range, for example by filtering excessive speaker responses in a frequency range around 3 to 4 kHz.

The trenches may be configured to provide increased conformability and provide venting across the flange. In some examples, the trenches 108, 112, and 114 of the retaining seal assembly 104 may be implemented in a combination of open configuration (referred to herein as "open trench") and blocked configuration (referred to herein as "blocked trench"). An open trench 108 and 114 may be shaped to provide conformability and to provide air venting across the flange, while a blocked trench 112 may be shaped to provide conformability while restricting air flow across the trench. In some examples, the retaining seal assembly 104 may include one or more open trenches 108 and 114 and one or more blocked trenches 112. In some examples, the lateral flange 106 may include one or more open trenches 108 and the medial flange may include one or more open trenches 114 and one or more blocked trenches 112. It will be appreciated that any combination of open trenches 108 and 114 and blocked trenches 112 may be provided. A blocked trench 112 may be formed by a restriction along the length of the trench, or by terminating the trench at or before the lip 116 of the flange, as illustrated by example blocked trench 112.

Figure 6:
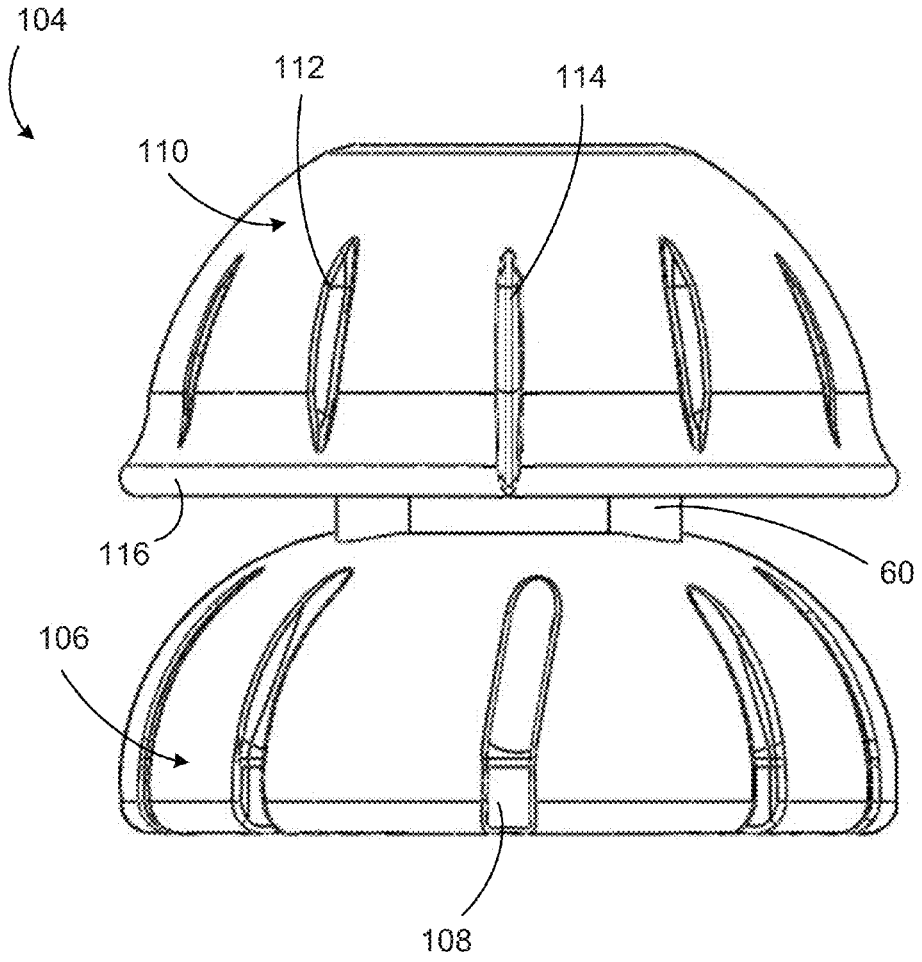
FIG. 6 is a side view of a retaining seal assembly showing a partially trenched medial flange coupled to an open trenched lateral flange by a sleeve section, according to some examples.

FIG. 6 is a side view of a retaining seal assembly showing a medial flange 106 coupled to a lateral flange 110 by a sleeve section 60, according to some examples. The sleeve section 60 may be provided as an integral part of the compliant seal assembly 104. The sleeve section 60 may be provided in a relatively central portion of the retaining seal assembly 104 while the flanges are provided relatively further out along a radial axis. In some examples, the sleeve section 60 may shaped to accommodate the medial end of a canal hearing device 100. In some examples, the sleeve section 60 is coupled to the clip element 150. In some examples, the sleeve section 60 is coupled to the clip element 150 using an adhesive.

Figure 7:
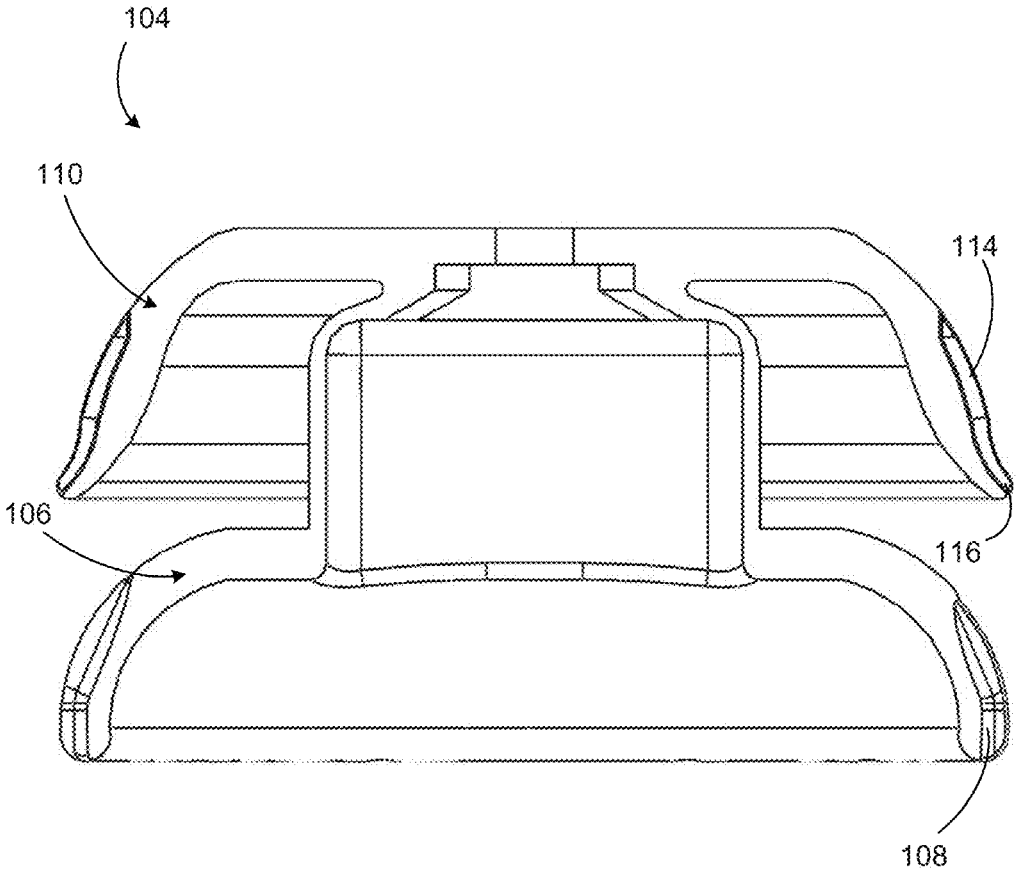
FIG. 7 is a sectional view of the retaining seal assembly of FIG. 6 showing air pathways provided by trenches of the medial flange and the lateral flange, according to some examples.

FIG. 7 is a sectional view of the retaining seal assembly 104 of FIG. 6 showing air pathways provided by open trenches 108 and 114 of the medial flange 110 and the lateral flange 106, according to some examples. The open trenches 108 and 114 are provided along an outer circumference of the flanges 106 and 110. The open trenches 114 of the medial flange 110 allow for air to pass through flange lip 116 for air venting. The open trenches 108 of the lateral flange 106 allow for air to pass through for air venting. The open trenches 108 and 114 may be configured as control acoustic conduits on the exterior surface of the retaining seal assembly 104 for pressure equalization and/or occlusion relief thereon.

The dimensions of the trenches 108, 110, and 112 may be set to achieve a desired amount of conformability, acoustic impedance, and air venting. In some examples, the trenches 108, 112, and 114 are provided in varying sizes. The lateral portion of the ear canal 10 may be more physiologically active. One or more lateral trenches of the lateral flange 106 (e.g., trench 108) may be relatively larger and more open as compared to one or more medial trenches of the medial flange 110 (e.g., trenches 112 and 114) thus providing more air venting in the physiologically more active region of the ear canal 10, while improving acoustic sealing in the medial portion of the ear canal 10, e.g., by virtue of smaller trenches in the medial flange 110. This configuration may provide occlusion relief by providing relatively larger air venting through the lateral flange 106 compared to the medial flange 110. In some examples, the trenches 108, 112, and 114 of the medial flange 110 and the lateral flange 106 have a length of at least 2 mm. In some examples, the medial trenches 112 and 114 of the medial flange 110 may be relatively narrow and more restrictive, having a width in the range of about 0.2 mm to about 0.4 mm. In some examples, the lateral trenches 108 of the lateral flange 106 are less restrictive and have a relatively larger width, relative to the medial flange, in the range of about 0.4 mm to about 0.6 mm. In some examples, the trenches 108, 112, and 114 provide controlled acoustic leakage by providing a cumulative cross-sectional area exceeding about 2 $mm^2$ for the lateral flange 106 and less than about 1 $mm^2$ for the medial flange 110. This configuration provides significant venting and occlusion relief at frequencies below 250 Hz, and providing a path of least resistance away from the eardrum 15 by the relatively small venting of the medial flange 110, while maintaining at least about 12 decibels of acoustic attenuation at 1 kHz and above for the hearing device in-situ to allow significant acoustic amplification without feedback at frequencies of typical hearing loss. In some examples, the thickness of the compliant flanges (e.g., medial flange 110 and lateral flange 106) in a non-trenched area of the respective flange (e.g., area 62 and 64) may be in the range of about 0.5 min to about 1.2 mm. In some examples, the retaining seal assembly 104 is offered in assorted sizes to various fit individuals according to the size and shape of the ear canal 10.

Figure 8A:
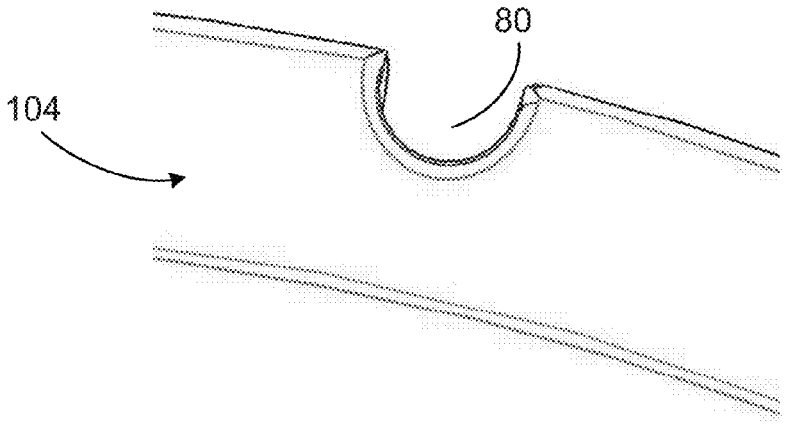
FIG. 8A is a cross-sectional view of a semi-circular trench of a retaining seal assembly, according to some examples.
Figure 8B:
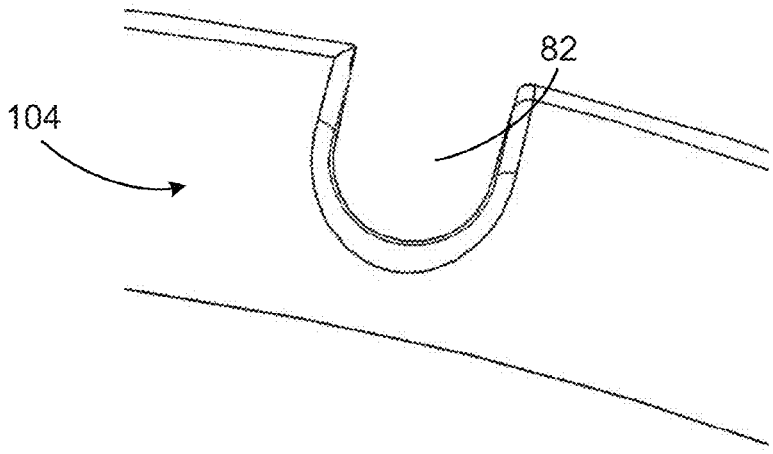
FIG. 8B is a cross-sectional view of a U-shaped trench of a retaining seal assembly, according to some examples.
Figure 8C:
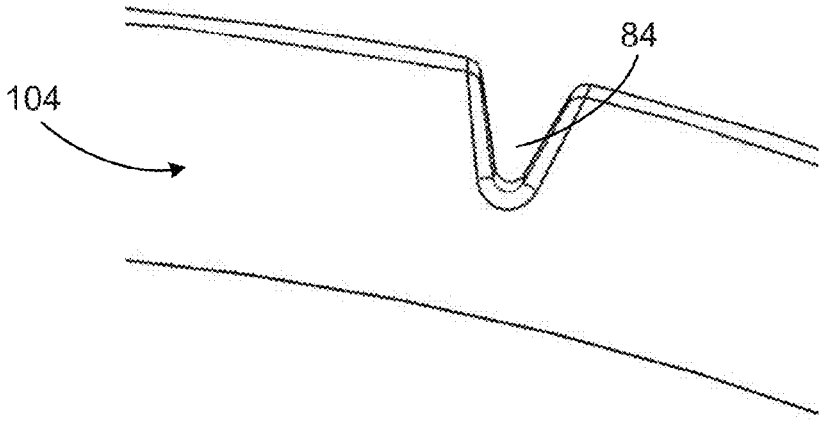
FIG. 8C is a cross-sectional view of a V-shaped trench of a retaining seal assembly, according to some examples.

FIGS. 8A-C show examples of different types of trenches that may be provided on the exterior surface of the flanges. FIG. 8A is a cross-sectional view of a trench having a semi-circular groove, according to some examples. FIG. 8B is a cross-sectional view of a trench having a U-shaped groove 82, according to some examples. In the example in FIG. 8B, the U-shaped groove 82 comprises a semi-circular bottom portion and opposing walls extending from the semi-circular bottom portion to the exterior surface of the flange. FIG. 8C is a cross-sectional view of a trench having a V-shaped groove 84, according to some examples. In the example in FIG. 8C, the V-shaped groove 84 comprises opposing walls that taper towards each other from the exterior surface of the flange toward the bottom portion of the trench. It will be appreciated that a variety of different shaped trenches may be provided. In some examples, a combination of shapes may be used for the trenches of the retaining seal assembly 104. The shape of a trench may provide certain air venting and/or conformability characteristics.

Figure 9:
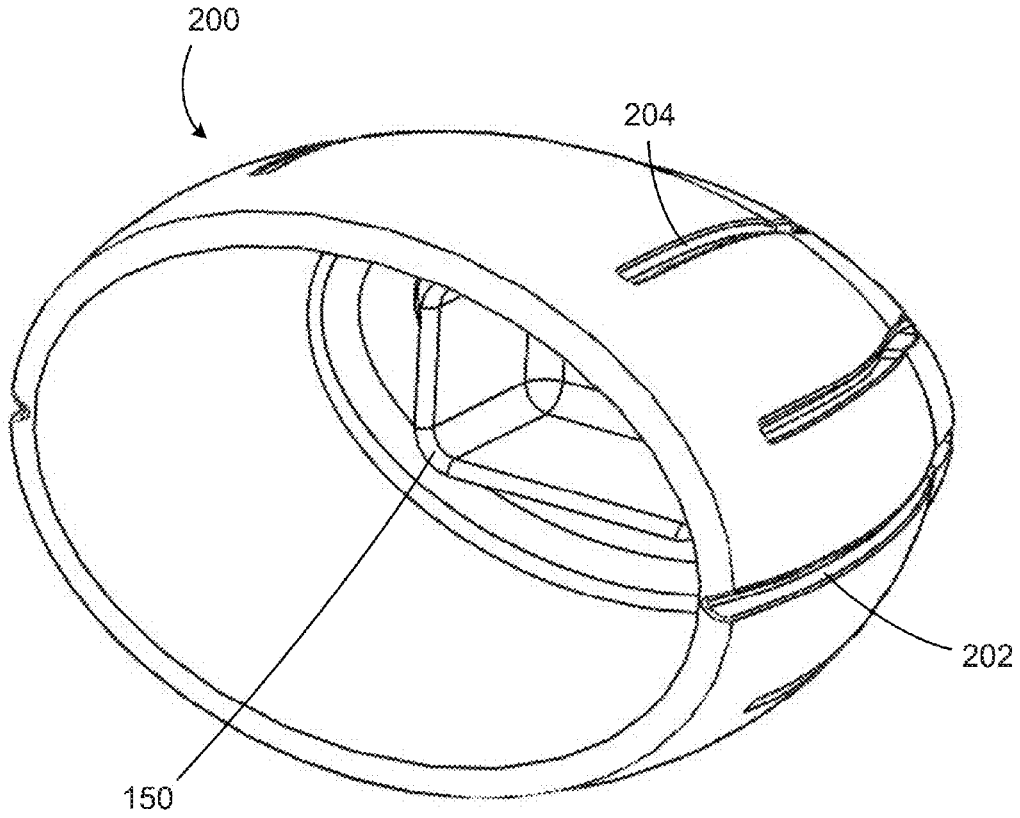
FIG. 9 is an isometric view of a single flange retaining seal assembly, according to some examples.

FIG. 9 is an isometric view of a single flange retaining seal assembly 200, according to some examples. The single flange retaining assembly 200 may include a flange provided concentrically around the canal hearing device 100 or a portion thereof. The single flange retaining seal assembly 200 may include open trenches 202 and blocked trenches 204. The number, distribution, and dimensions of the open trenches 202 and blocked trenches 204 may provide a desired acoustic impedance, venting and conformability along the walls of the ear canal. The single flange retaining assembly 200 may include a clip element 150 for coupling to the canal hearing device 100.

Figure 10:
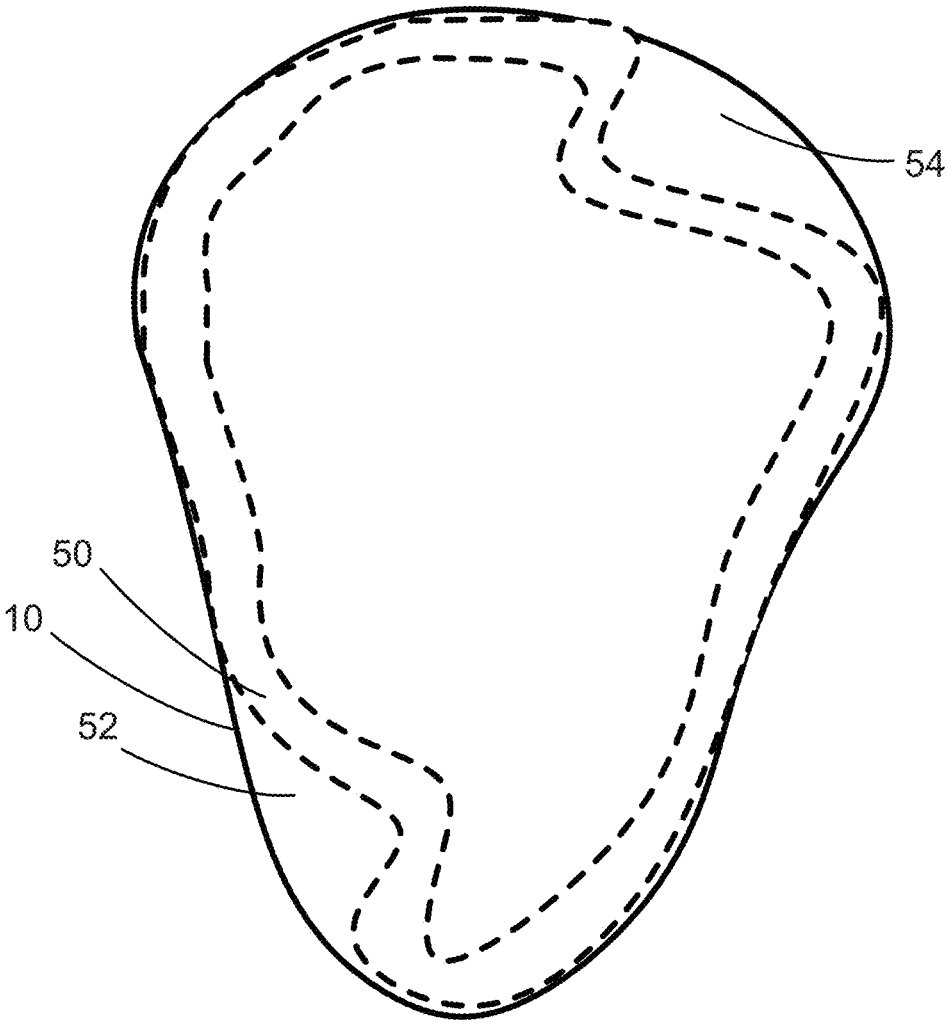
FIG. 10 is a cross-sectional view of a conventional seal in the ear canal, showing buckling when compressed inside the ear canal.

Seal assemblies for canal hearing devices, as described herein, may include features which improve wear comfort and/or acoustic performance of a canal hearing device. Conventional seals for hearing devices (e.g., seal 50 of FIG. 10) may not uniformly conform to the ear canal 10 when inserted therein. Such non-uniform conformance may cause buckling of the seal 50 which may cause excessive venting (gaps 54 and 52) and discomfort to the wearer. Excessive venting causes uncontrolled leakage and feedback, a major concern in hearing device use.

Figure 11:
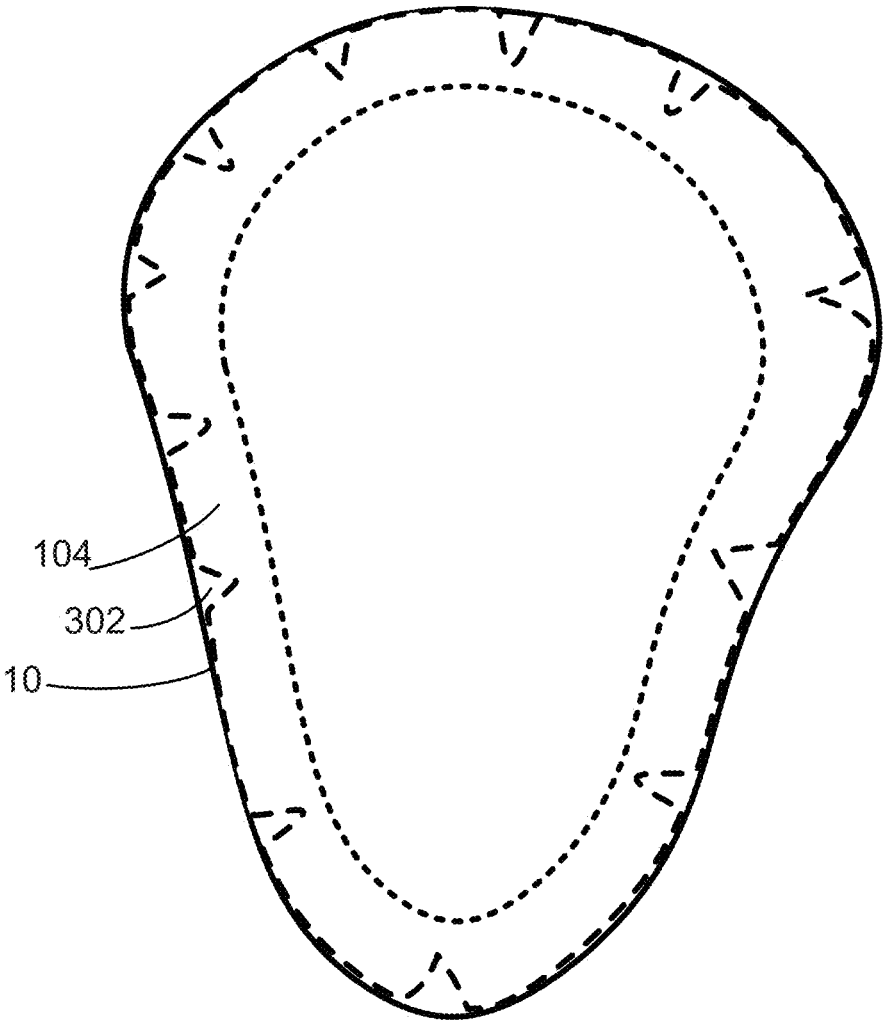
FIG. 11 is a cross-sectional view of a retaining seal assembly in the ear canal, according to some examples, showing conforming and controlled venting inside the ear canal.

FIG. 11 shows a cross-sectional view of a retaining seal assembly 104 of the present invention in the ear canal 10, according to some examples. The trenches 108 and 302, which may be open trenches along the perimeter of the retaining seal assembly 104, may provide more uniform distribution of the concentric compressive forces inside the ear canal 10. Retaining seal assemblies comprising trenches according to the present disclosure may be less likely to buckle, thus providing controlled venting and conformability inside the ear canal 10. This configuration may provide more efficient occlusion relief, feedback mitigation, and comfort of wear for the user. It should be understood by those skilled in the art that the air venting provides pressure equalization during insertion, removal, or during pressure changes when the canal hearing device 100 is worn in the ear canal 10.

Table 1 shows attenuation for a lateral flange 106 of a prototype retaining seal assembly 104 at various audiometric frequencies (Hz) and compression percentage (%). The prototype seal comprised 12 trenches of approximately 0.35 mm in width and depth, and approximately 0.75 mm in thickness. The table shows significant acoustic attenuation for frequencies 250 Hz and above, with relatively substantial acoustic leakage (less than 10 dB of attenuation) at the frequency of 125 Hz for occlusion relief. The results show low-pass filtering characteristics with a cut-off between 125 and 250 Hz. Alternate low-pass cut-off frequencies may be obtained by altering the size and number of trenches.

TABLE 1

| | 125 Hz | 250 Hz | 500 Hz | 1 kHz | 2 kHz | 4 kHz | 6 kHz |
|---|---|---|---|---|---|---|---|
| 1.8% | −3.3 dB | −26.1 dB | −24.6 dB | −22.1 dB | −19.6 dB | −15.4 dB | −6.2 dB |
| 7.2% | −5.8 dB | −31.3 dB | −29.6 dB | −27.7 dB | −27.3 dB | −19.7 dB | −11.8 dB |
| 12.5% | −6.9 dB | −31.1 dB | −28.5 dB | −26.7 dB | −25.7 dB | −19.4 dB | −12.0 dB |

Although embodiments of the invention are described herein, variations and modifications of these embodiments may be made, without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A retaining seal assembly for a canal hearing device, comprising:

a medial flange formed of a compliant material and comprising relatively small medial trenches along an exterior surface of the medial flange, wherein the medial flange is configured to conform to a shape of an ear canal and distribute concentric compressive forces when the retaining seal assembly is inserted in the ear canal;

a lateral flange irremovably coupled to the medial flange, wherein the lateral flange is formed of the compliant material and comprising relatively large lateral trenches along an exterior surface of the lateral flange, wherein the lateral flange is configured to conform to the shape of the ear canal and distribute concentric compressive forces when the retaining seal assembly is inserted in the ear canal; and a relatively rigid clip element, wherein at least one of the medial and lateral flanges is concentrically positioned over the clip element, wherein the lateral trenches and medial trenches are sized and configured to provide acoustic sealing in an audiometric frequency range and low frequency venting when the retaining seal assembly is placed in the ear canal.

2. The retaining seal assembly of claim 1, wherein the lateral flange is configured to provide occlusion relief.

3. The retaining seal assembly of claim 1, wherein any of the lateral and medial flanges comprise at least one blocked trench and at least one open trench.

4. The retaining seal assembly of claim 3, wherein the at least one blocked trench is shaped to increase conformability of the seal assembly and the at least one open trench provided to increase venting.

5. The retaining seal assembly of claim 1, wherein the lateral and medial flanges are formed from any of a Silicone and a neoprene material.

6. The retaining seal assembly of claim 1 configured to provide at least 12 dB of acoustic attenuation at an audiometric frequency within the range of 1000-4000 Hz.

7. The retaining seal assembly of claim 1, wherein at least one of the medial and lateral trenches has a length of at least 2 mm.

8. The retaining seal assembly of claim 1, wherein one or more of the medial trenches of the medial flange have a width in the range of 0.2-0.4 mm.

9. The retaining seal assembly of claim 1, wherein one or more of the lateral trenches of the lateral flange have a width in the range of 0.4-0.6 mm.

10. The retaining seal assembly of claim 1 further comprising a debris barrier.

11. The retaining seal assembly of claim 10, wherein the debris barrier comprises a membrane.

12. The retaining seal assembly of claim 10, wherein the debris barrier is configured to provide a minimum acoustic attenuation of less than 3 dB across an audiometric frequency range.

13. The retaining seal assembly of claim 1, wherein the medial and lateral flanges are non-removably attached to the clip element.

14. The retaining seal assembly of claim 1, wherein the lateral flange comprises at least 6 lateral trenches.

15. The retaining seal assembly of claim 1, wherein the medial flange comprises at least 6 medial trenches.

16. The retaining seal assembly of claim 1, wherein the clip element has a thickness of 0.3 mm or less.

17. The retaining seal assembly of claim 1, wherein the clip element comprises one or more locking tabs.

18. The retaining seal assembly of claim 17, wherein the one or more locking tabs comprise a cut-out.

19. The retaining seal assembly of claim 1, wherein a thickness of at least one of the medial flange and the lateral flange in a non-trench area of the respective flange is in the range of 0.5-1.2 mm.

20. The retaining seal assembly of claim 1, wherein at least one of the lateral and medial trenches comprise a control acoustic conduit configured to provide pressure equalization across the canal hearing device when placed in the ear.

21. The retaining seal assembly of claim 1, wherein a cross-sectional shape of one or more of the lateral and medial trenches is selected from the group consisting of a semi-circular groove, a U-shaped groove, and a V-shaped groove.

22. The retaining seal assembly of claim 1, wherein the clip element is formed from any of plastic, metal or nylon materials.

23. The retaining seal assembly of claim 1, wherein the clip element is configured for removably coupling the retaining seal assembly to the canal hearing device.

24. The retaining seal assembly of claim 10, wherein the debris barrier is configured to provide acoustic filtering in a frequency range of 3-4 kHz.

25. A retaining seal assembly for a hearing device, comprising:

a plurality of compliant flanges, wherein at least one flange from the plurality of flanges comprises a plurality of elongate trenches along an exterior surface of the at least one flange, wherein the plurality of elongate trenches are configured to compress and conform to a shape of an ear canal and to distribute concentric compressive forces when the retaining seal assembly is inserted in the ear canal, wherein the plurality of elongate trenches are configured as a low pass acoustic filter to provide acoustic attenuation at 1000 Hz and above, and acoustic leakage below 250 Hz.

26. The retaining seal assembly of claim 25, wherein the seal assembly is configured to be removably coupled to a hearing device or a portion thereof.

27. The retaining seal assembly of claim 25 further comprising a clip element formed of a relatively thin, rigid material, the clip element configured for removably attaching the retaining seal assembly to a hearing device or a portion thereof.

28. The retaining seal assembly of claim 27, wherein the clip element comprises one or more locking tabs.

29. The retaining seal assembly of claim 27, wherein the clip element is formed of plastic or nylon materials.

30. The retaining seal assembly of claim 25, wherein the elongate trenches comprise at least one blocked trench and at least one open trench.

31. A retaining seal assembly for a canal hearing device, comprising:

at least one compliant flange comprising at least 6 elongate trenches along an exterior surface of the flange, wherein the flange is configured to conform to a shape of an ear canal and distribute concentric compressive forces when the retaining seal assembly is inserted in the ear canal, wherein the elongate trenches are configured to provide at least 12 dB of acoustic attenuation at a frequency range of 1000-4000 Hz and less than 10 dB of acoustic attenuation at 125 Hz and below; and a debris barrier configured to provide protection for a sound port of a canal hearing device in-situ.

32. The removable retaining seal assembly of claim 31 further comprising a clip element formed of a relatively thin, rigid material, wherein the clip element is configured for removably attaching the removable retaining seal assembly to the canal hearing device or a portion thereof.

33. The removable retaining seal assembly of claim 32, wherein the clip element comprises one or more locking tabs.

34. The removable retaining seal assembly of claim 32, wherein the clip element is formed of a plastic material or a nylon material.

35. The retaining seal assembly of claim 31, wherein the elongate trenches comprise at least one blocked trench and at least one open trench.

* * * * *